US010287759B2

(12) United States Patent
Macey

(10) Patent No.: US 10,287,759 B2
(45) Date of Patent: May 14, 2019

(54) HOSPITAL SINK AND FAUCET

(71) Applicant: Franke Technology and Trademark Ltd, Hergiswil (CH)

(72) Inventor: Cory Macey, Midland (CA)

(73) Assignee: Franke Technology and Trademark Ltd, Hergiswil (CH)

( * ) Notice: Subject to any disclaimer, the term of this patent is extended or adjusted under 35 U.S.C. 154(b) by 0 days.

(21) Appl. No.: 15/572,987

(22) PCT Filed: May 20, 2016

(86) PCT No.: PCT/EP2016/061509
§ 371 (c)(1),
(2) Date: Nov. 9, 2017

(87) PCT Pub. No.: WO2016/188929
PCT Pub. Date: Dec. 1, 2016

(65) Prior Publication Data

US 2018/0100296 A1 Apr. 12, 2018

Related U.S. Application Data

(60) Provisional application No. 62/165,521, filed on May 22, 2015.

(51) Int. Cl.
*E03C 1/18* (2006.01)
*E03C 1/05* (2006.01)
(Continued)

(52) U.S. Cl.
CPC ..... *E03C 1/057* (2013.01); *E03C 1/14* (2013.01); *E03C 1/16* (2013.01); *E03C 1/18* (2013.01)

(58) Field of Classification Search
CPC ... E03C 1/057; E03C 1/16; E03C 1/14; E03C 1/181; E03C 1/046; E03C 1/0404; B05B 1/34
(Continued)

(56) References Cited

U.S. PATENT DOCUMENTS 1,676,035 A * 7/1928 Lehnert ..... B05B 1/04 239/590
3,850,808 A * 11/1974 Hoermann ..... B01D 21/02 210/195.3
(Continued)

FOREIGN PATENT DOCUMENTS

| | | |
|---|---|---|
| DE | 20021035 | 4/2002 |
| WO | 9802075 | 1/1998 |
| WO | 2012087302 | 6/2012 |

*Primary Examiner* — Erin Deery
(74) *Attorney, Agent, or Firm* — Volpe and Koenig, P.C.

(57) ABSTRACT

A hospital sink and faucet assembly includes a sink with a sink body having an angled faucet deck, a bowl adapted to receive water, and a rim. A laminar flow faucet is connected to the faucet deck and includes an outlet adapted to direct a laminar flow water stream into the bowl. The faucet includes a chamber with a preferably tangential water inlet at the bottom and at least one mesh layer that extends across a cross-section of the chamber to creates a generally constant velocity profile for the water flow across the cross-section of the chamber. The water flow progresses upwardly in the chamber to the outlet where a laminar flow nozzle cuts the water and discharges a circular stream of water out an angle generally perpendicular to the deck and toward the sink bowl. An ozone generator is preferably also in the chamber.

17 Claims, 7 Drawing Sheets

(51) Int. Cl.
*E03C 1/14* (2006.01)
*E03C 1/16* (2006.01)

(58) Field of Classification Search
USPC ..... 4/619, 620, 624–626; 210/760, 748.19; 239/428.5, 461–524
See application file for complete search history.

(56) References Cited

U.S. PATENT DOCUMENTS

| | | | | | |
|---|---|---|---|---|---|
| 3,851,825 | A * | 12/1974 | Parkison | E03C 1/084 | 239/590.3 |
| 4,991,241 | A * | 2/1991 | Bergmann | E03C 1/04 | 4/619 |
| 6,484,953 | B2 * | 11/2002 | Freier | E03C 1/08 | 239/461 |
| 7,488,419 | B1 * | 2/2009 | Wang | C02F 1/78 | 210/198.1 |
| 8,440,080 | B2 * | 5/2013 | Salama | C02F 9/005 | 210/243 |
| 9,009,882 | B2 * | 4/2015 | Bucher | A47K 1/04 | 4/619 |
| 9,228,330 | B1 * | 1/2016 | Brown | G01K 1/02 | |
| 2004/0083546 | A1 * | 5/2004 | Tahara | A47K 1/04 | 4/619 |
| 2010/0206409 | A1 * | 8/2010 | Gautschi | E03C 1/0404 | 137/614 |
| 2011/0079519 | A1 * | 4/2011 | Widler | C02F 1/4672 | 205/743 |
| 2012/0124737 | A1 | 5/2012 | Gibson | | |
| 2018/0141844 | A1 * | 5/2018 | Macey | A61L 2/035 | |

* cited by examiner

HOSPITAL SINK AND FAUCET

FIELD OF INVENTION

The invention relates to hospital sink and faucet assembly as well as a method for using such sink and faucet assemblies.

BACKGROUND

Hospital sink and faucet assemblies are known which provide for touch-free washing by hospital personnel. While these are referred to as hospital sink and faucet assemblies, they are often used in other healthcare facilities, laboratories, and other applications, so the designation of "hospital sink and faucet assembly" is considered generic to this type of sink and faucet, regardless of the particular application.

Some of the known sinks are made from ceramic or porcelain and are not wheelchair accessible due to the base and housing. Additionally, such sinks typically use a goose neck faucet fixture and have a hand sensor which is activated by a user's hands passing beneath the faucet. Issues with such arrangements include splashing since the user's hands are general above the sink bowl. Further splashing can be caused due to turbulence in the water flow from the faucet and the bowl configuration.

It is also known to provide hospital sinks made from stainless steel material. These are generally used in operating suites and intensive care units. Aside from the material change, the drawbacks noted above generally apply. A further sink provided by the assignee of the present invention provides infection control features due to an antimicrobial coating in the bowl.

It would be desirable to provide an improved hospital sink and faucet arrangement that encourages proper hand-washing in a hospital or other healthcare facility as well as provide for reduced splashing and hands-free operation.

SUMMARY

Briefly stated, a hospital sink and faucet assembly are provided that allow for reduced splashing outside the sink while being usable in existing conditions. The unit is wall hangable and wheelchair accessible and also provides for lower cost production. Further, it features a look with a non-institutional feel while providing many other benefits as described in detail below.

The hospital sink and faucet assembly includes a sink with a sink body having an angled faucet deck, a bowl adapted to receive water, and a rim. A laminar flow faucet is connected to the faucet deck and includes an outlet adapted to direct a laminar flow water stream into the bowl. The laminar flow faucet includes an elongate, preferably generally cylindrical, chamber having a top and a bottom. A water inlet is located at the bottom of the chamber and the outlet is located at the top. A first mesh extends across a cross-section of the chamber at medial position between the top and the bottom to define a first chamber portion between the bottom and the first mesh. The first mesh has a first open area. The first mesh creates a generally constant velocity profile for the water flow across the cross-section of the chamber. A flow control valve is connected to the water inlet, and the deck is set at an angle downwardly from the horizontal toward the bowl and the outlet is located on the deck. This arrangement allows water to enter the chamber once the flow control valve is open and the water is directed circumferentially around the first chamber portion to create an orderly flowing motion and remove turbulence from the water flow. As the flow extends around the chamber up to the first mesh, the water passes through this first mesh, slowing the water velocity. The water then enters the second chamber portion in a more vertical direction and flows upwardly toward the second mesh. The second mesh further homogenizes the water flow into a constant velocity profile across the cross-section of the chamber such that the water is flowing in parallel layers without disruptions in order to achieve a laminar flow. This flow progresses upwardly toward the outlet where a laminar flow nozzle cuts the water and discharges a circular stream of water out an angle generally perpendicular to the deck and toward the sink bowl. Preferably, the deck is angled downwardly between 30 degrees and 60 degrees. Here, the stream of water is laminar and does not include any air bubbles or internal turbulence, drastically reducing splashing when it comes into contact with another surface or a user's hands.

The chamber is normally filled with water and when a user places their hands in front of a sensor adapted to control the flow control valve, the valve opens and power is sent to an ozone generator preferably located within the chamber. When a user moves their hands away from the sensor in order to lather, for preferably a minimum of 20 seconds as recommended by the World Health Organization (WHO), the flow control valve is turned off, but the ozone generator continues to run building the ozone concentration in the water within the chamber which dramatically improves the effectiveness of continued hand washing during the rinse. Alternatively, a higher output ozone generator could be employed for which such run on time is not need, thus reducing maintenance costs.

Preferably the ozone generator is located in the first chamber portion and extends along an axis of the chamber.

Preferably, the sensor that detects the presence of a user's hands is connected to a controller that is configured to actuate the ozone generator for a pre-determined time period upon receiving a signal from the sensor of the user's presence, and is also configured to open the flow control valve. In a particularly preferred embodiment, the sensor is an IR sensor that is located in a wall of the bowl below the faucet. This causes a user to extend their hands downwardly into the bowl in order to actuate the faucet, further reducing splashing.

Preferably, the controller is configured to run an automatic cycle on a periodic basis in which the ozone generator is activated, and after a pre-determined time period, the controller opens the flow control valve to flush the sink with ozone-rich water.

In a preferred arrangement, the first mesh is formed of PTFE and has an open area of 55%-85%, more preferably 65%-75%. Preferably, the mesh is formed with 40-60 holes per square inch.

Preferably, a second mesh extends across the cross-section of the chamber at a location between the first mesh and the top, defining a second chamber portion between the first and second meshes and a third chamber portion between the second mesh and the top, the second mesh having a second open area that is less than the first open area. Preferably, the second mesh is also formed of PTFE and has an open area of 30%-65%, more preferably 40%-55%. The second mesh includes a greater number of holes per square inch, preferably in the range of 70-90 holes per square inch.

Alternatively the same type of meshes can be used as first and second meshes, for instance the meshes can both be formed of T316 stainless steel with an open area of 30%-50%, more between 35% and 45%, for instance approximately 41%.

In a preferred arrangement, a nozzle is located in the outlet, which is preferably a laminar flow nozzle. The nozzle opening sets the flow rate, which is preferably 1.5-2.2 gallons per minute (5.7-8.3 l/min). However, other flow rates could be provided.

In a preferred embodiment, an axis extends perpendicular to the deck at the laminar flow outlet and a water illumination LED is mounted to the chamber in a position aligned with the outlet axis. The controller is configured to activate the LED upon opening the flow control valve. The LED directs a beam of light along the water outlet axis illuminating the laminar flow water stream exiting the outlet.

In a preferred embodiment, the laminar flow faucet is located below the deck and behind the bowl. This provides a clean appearance with only a small bezel located around the outlet.

Preferably, an overflow port is located between the top of the chamber and the outlet. The overflow port allows for the increased volume of water in the chamber due to the ozone generator being operational to be discharged to a drain line without flowing into the sink. Instead, the excess water is discharged through the hidden overflow port located beneath the deck and directed into the drain line via hidden tubing located behind the sink.

In a particularly preferred arrangement, a water diversion rib extends up from a bottom of the bowl and is aligned with a position of the laminar flow water stream discharged from the outlet. This also reduces splashing.

In other aspects of the invention, a laminar flow faucet as well as a method of using a sink and touchless faucet assembly are provided which, along with other aspects and details of the invention, are described below and in the Claims and have not been repeated here.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
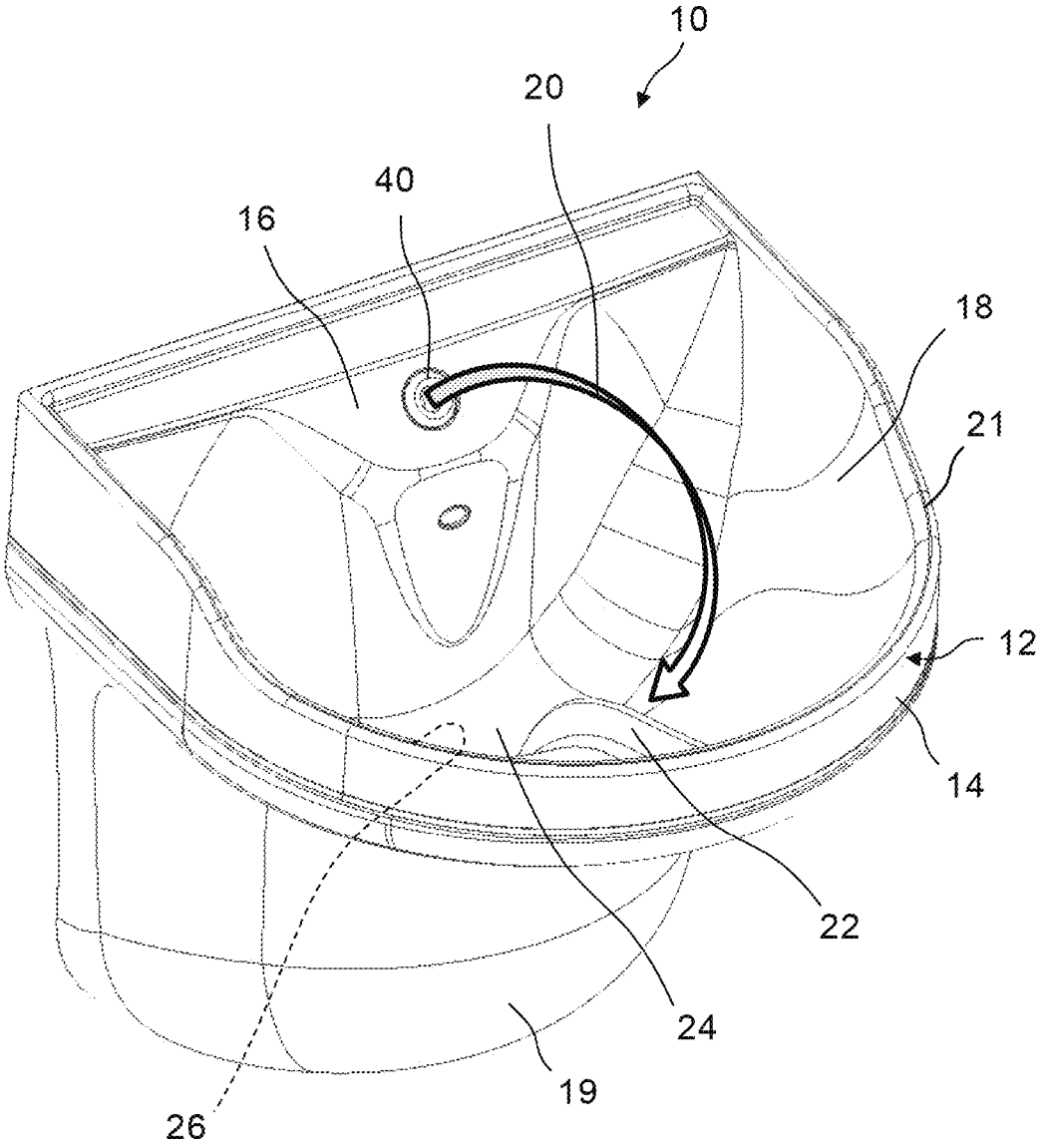
FIG. 1 is a top, front, right perspective view of a hospital sink and faucet assembly in accordance with one embodiment.
Figure 2:
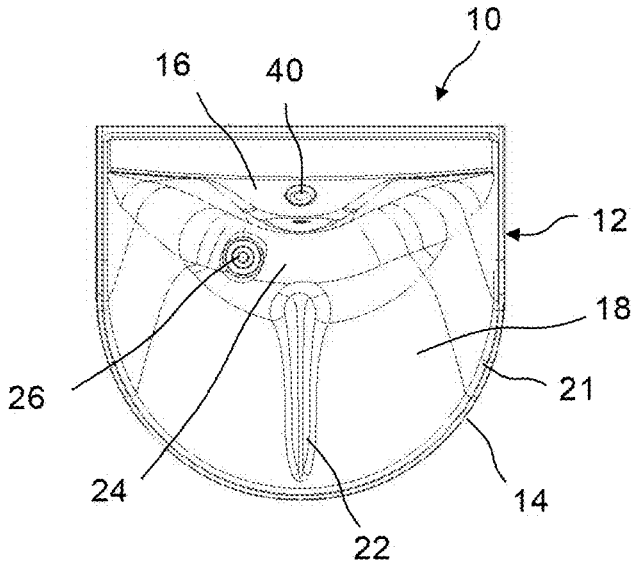
FIG. 2 is a top plan view of the hospital sink and faucet assembly shown in FIG. 1.
Figure 3:
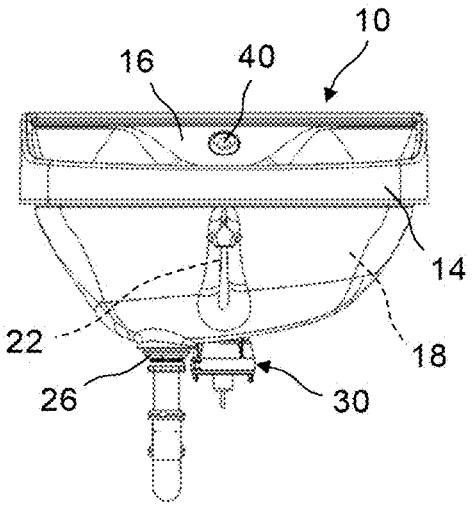
FIG. 3 is a front elevational view of the hospital sink and faucet assembly shown in FIG. 1.
Figure 4:
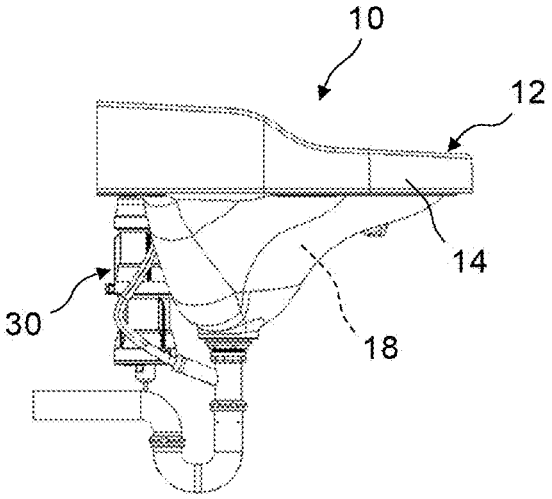
FIG. 4 is a left side elevational view of the hospital sink and faucet assembly shown in FIG. 1.

Certain terminology is used in the following description for convenience only and is not limiting. The words "front", "rear", "upper", and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Referring to FIGS. 1-4, a hospital sink and faucet assembly 10 is shown in detail. As shown in FIG. 1, the sink 12 includes a sink body 14 with an angled faucet deck 16, a bowl 18 that is adapted to receive water, and a rim 21. A shroud 19 is mounted below the sink 12 to hide the drain pipe and siphon and, as will be explained in more detail below, faucet assembly. The angled faucet deck 16 is shown more clearly in FIGS. 6 and 7 and is preferably angled between approximately 30 degrees and 60 degrees with respect to horizontal downwardly toward the bowl 18. As shown in detail in FIGS. 1 and 2, preferably a water diversion rib 22 extends up from a bottom of the bowl 18 and is aligned with a position of the laminar flow water stream 20 that is discharged from an outlet 40 of the laminar flow faucet assembly 30, described in further detail below.

Figure 5:
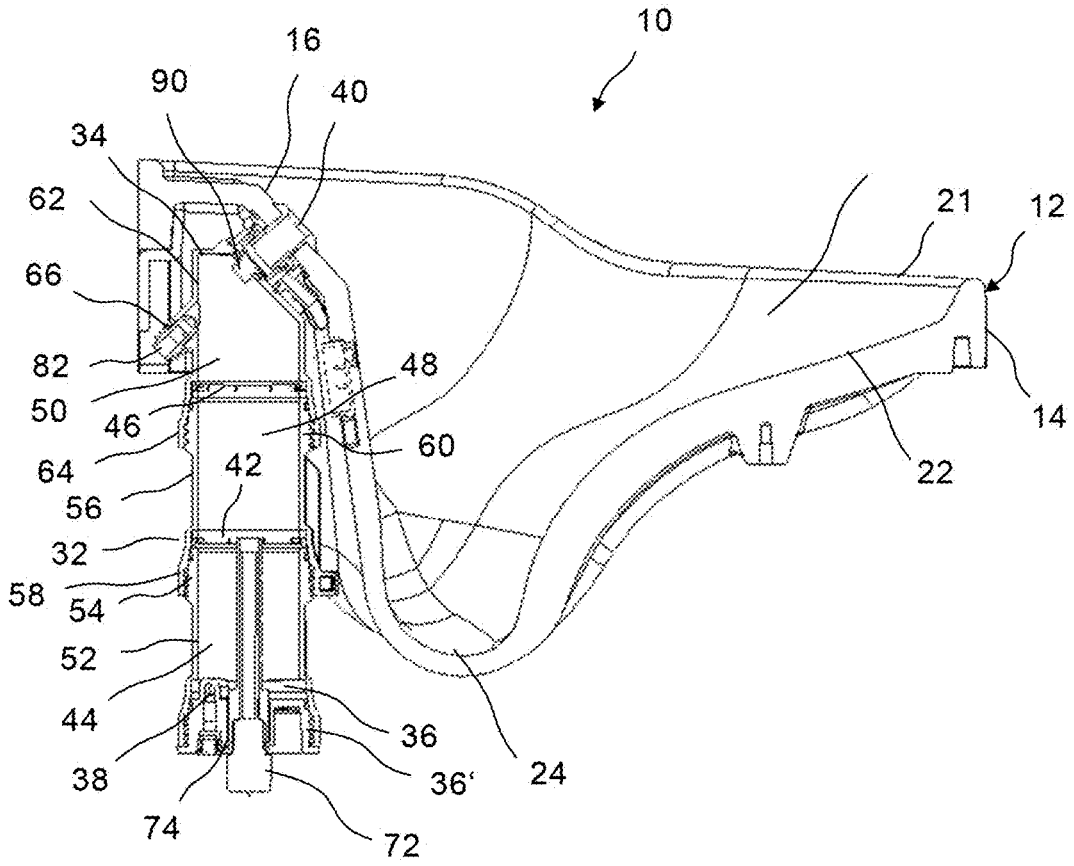
FIG. 5 is an enlarged perspective view, partially cut away, of the hospital sink and faucet assembly showing the detailed configuration of the faucet assembly hidden behind a back wall of the sink bowl.

The sink 12 preferably includes a sloped bottom 24, shown in detail in FIGS. 1 and 5 with an offset drain 26 that is offset axially from a center line of the sink, to the left in the illustrated embodiment. In the preferred embodiment, the sloped bottom 24 is asymmetric, being higher on the right side and sloping downwardly to the drain 26 on the left side. The water diversion rib 22 and the sloped bottom 24 assist in reducing splashing of the water stream 20 entering the sink 12 during use.

Preferably, the sink 12 is made from a molded polymeric material. However, it could also be formed from a ceramic or porcelain material or stainless steel. In yet another alternative, the sink can be made from a resin set calcium powder. The latter material provides a very solid surface.

Figure 6:
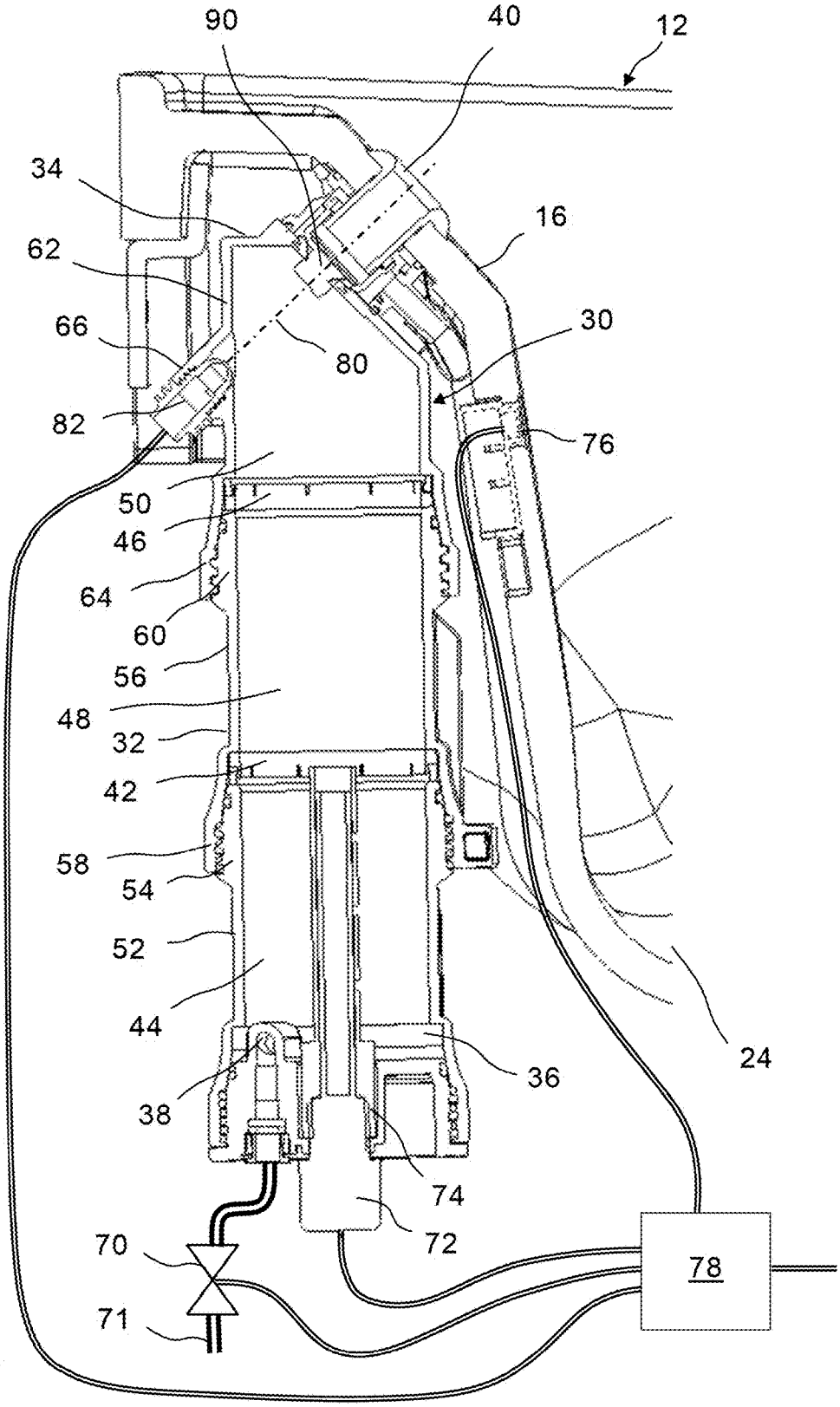
FIG. 6 is an enlarged cross-sectional view through the faucet assembly located behind the sink bowl.
Figure 7:
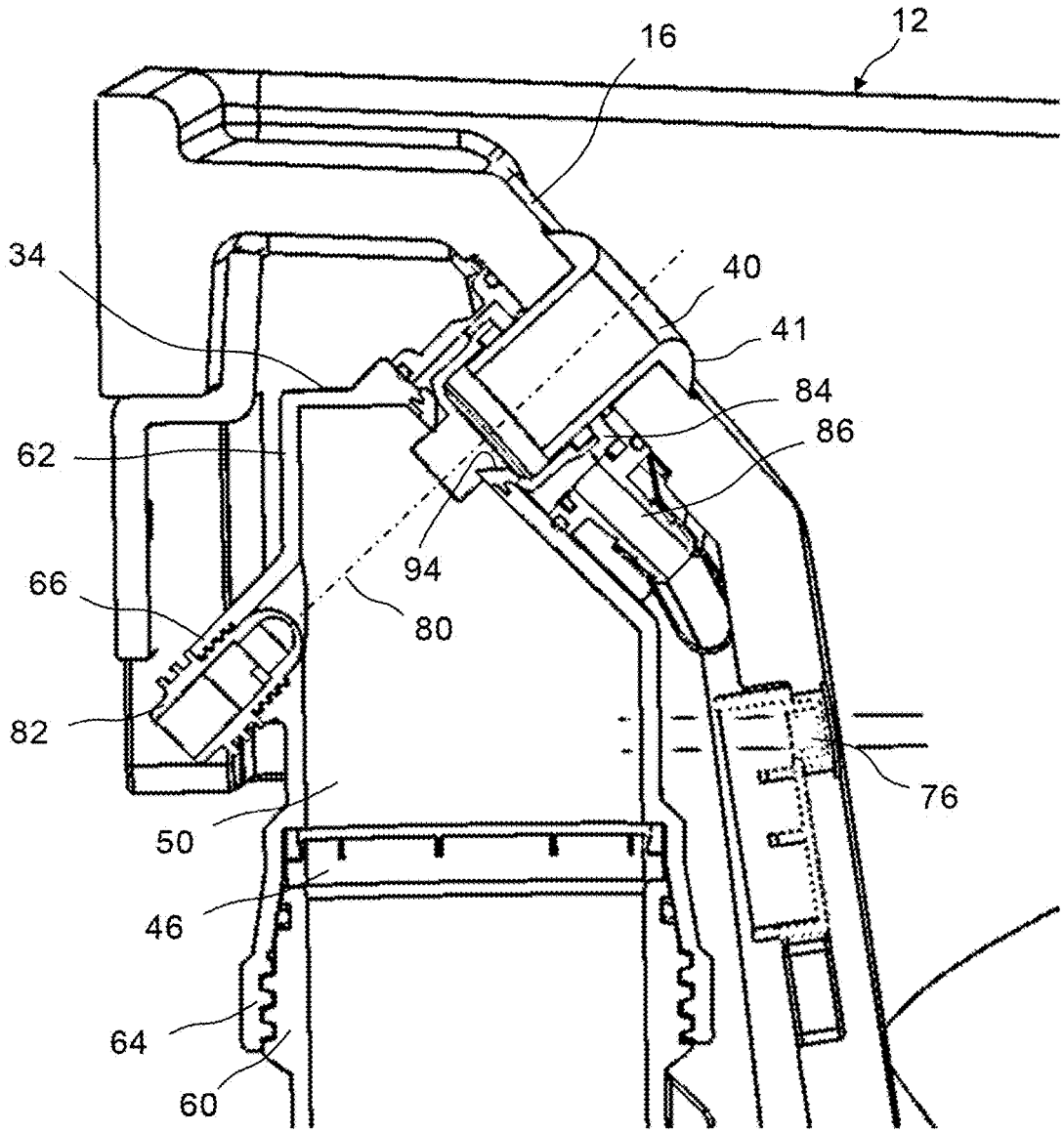
FIG. 7 is an enlarged detailed view, shown in cross section, of the outlet from the faucet assembly.

Referring now to FIGS. 5-8, the laminar flow faucet assembly 30 is shown. The laminar flow faucet assembly is connected to the faucet deck 16, as shown in FIG. 7, and includes an elongate, preferably generally cylindrical, chamber 32 having a top 34 and a bottom 36. A water inlet 38 is arranged at the bottom 36. The bottom 36 is formed as part of a bottom cap 36'. The water inlet 38 is preferably tangentially arranged in order to allow water to enter the chamber 30 in the circumferential direction, imparting a swirling motion. In the embodiment, the water inlet 38 is formed as part of the bottom cap 36' with a 90 degree elbow to keep the water input tangentially. The outlet 40 is located at the top 34. A first mesh 42 extends across a cross-section of the chamber 32 at a medial position between the top 34 and the bottom 36 to define a first chamber portion 44 between the bottom 36 and the first mesh 42. The first mesh has a first open area. The open area is preferably 55%-85%, and more preferably 65%-75%. The first mesh is preferably formed of PTFE and has in the range of 40-60 holes per square inch. The term "mesh" as used herein is intended in a broad sense, and can be a woven or non-woven material that includes an array of openings, a perforated disk, or any other suitable structure that divides the water flow to form a generally constant velocity profile across the cross-section of the chamber 30. Those skilled in the art will recognize that other materials and sizes can be used for the mesh.

Specifically referring to FIGS. 5 and 6, preferably a second mesh 46 extends across the cross-section of the chamber 32 at a location between the first mesh 42 and the top 34. A second chamber portion 48 is defined between the first mesh 42 and the second mesh 46, and a third chamber portion 50 is defined between the second mesh 46 and the top 34. The second mesh has a second open area that is less than the open area of the first mesh. Preferably, the second mesh has an open area of between 30% and 65%, and more preferably between 40% and 55%. In one preferred embodiment, the second mesh has between 70 and 90 holes per inch. The second mesh 46 acts to further equalize and form the constant velocity laminar water flow from the water that rises through the chamber 32 toward the outlet 40.

Figure 8:
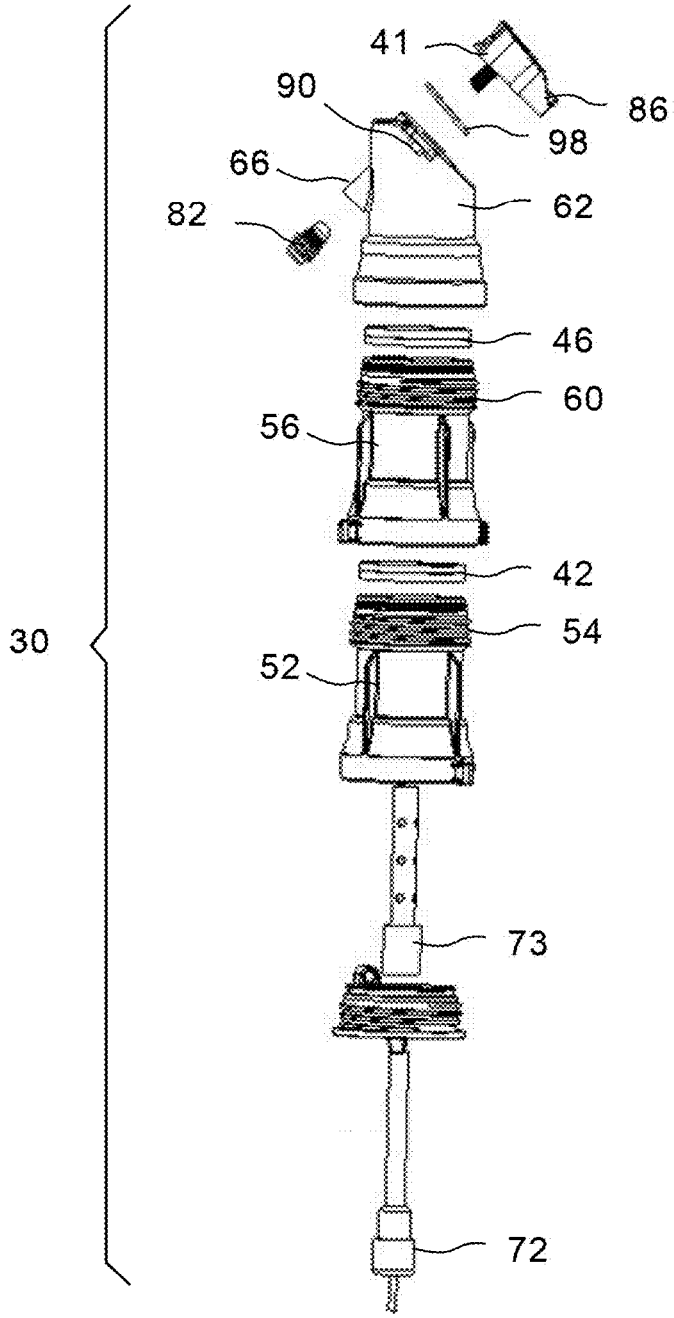
FIG. 8 is an exploded view showing the faucet assembly.
Figure 10:
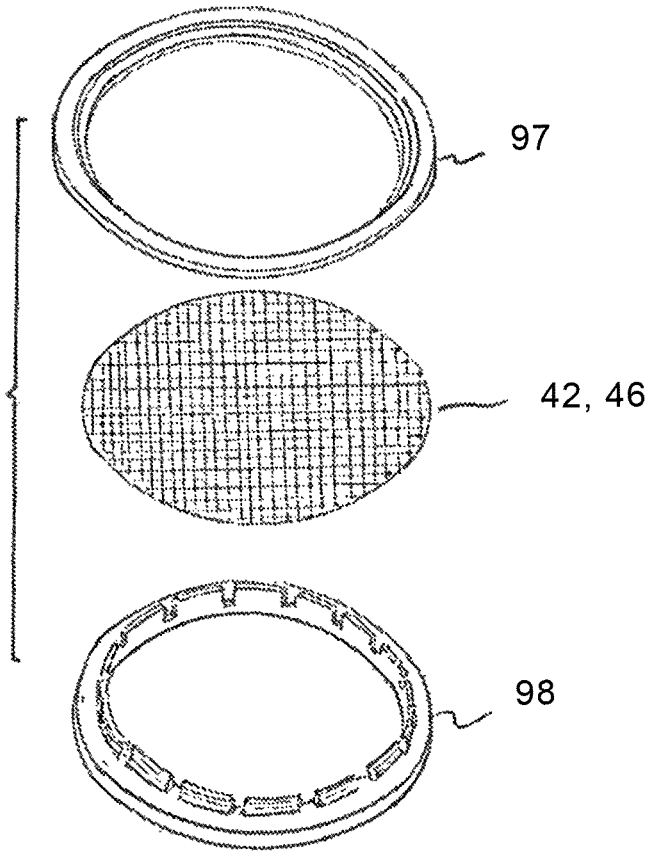
FIG. 10 is an exploded view of a mesh assembly formed of the mesh, a holding ring, and a clamping ring.

In a preferred embodiment, illustrated in FIG. 8, the generally cylindrical chamber 32 is assembled from a bottom portion 52 having external threads 54 at the upper end. The first mesh 42 is installed on the upper end. The mesh 42 can be formed as integral part of a molded mesh retainer by overmolding the mesh so that the mesh and mesh retainer form a single piece as shown in FIG. 8. Alternatively, a mesh retainer assembly can be used formed from a mesh holding ring 96 and a mesh clamping ring 97 that clamps the actual mesh 42 to the holding ring 97, as shown in FIG. 10, which are pre-assembled prior to installation. The mesh holding and clamping rings 96, 96 are preferably snapped together to hold the mesh 42, and are preferably made of a polymeric material. A middle sleeve 56, shown in cross section in FIG. 6, includes internal threads 58 at the bottom end, shown in FIG. 6, which engage the external threads 54 at the top of the bottom portion 52 in order to hold the first mesh 42 in position. The middle sleeve 56 also includes external upper thread 60. The second mesh 46 is preferably installed in a similar manner to the first mesh 42, pre-assembled with a mesh holding ring 96 and a mesh clamping ring 97 that are on top of the middle sleeve 56. A cap 62 having a generally closed top and an open bottom with internal threads 64, as shown in FIG. 6, is then connected to the external thread 60 at the top of the middle sleeve 56. The cap 62 includes the LED port 66, described in further detail below as well as the opening for the outlet 40 located on a canted top surface having generally the same angle as the faucet deck 16. Seals or a sealant material can be used at the threaded connections. Preferably, the bottom 52, middle sleeve 56, and cap 62 are made of a polymeric material. However, those skilled in the art will recognize that other materials could be used.

Referring now to FIG. 6, a flow control valve 70 is connected to the water inlet 38 which brings a flow of water from a supply tube 71 into the water inlet 38. The valve 70 is preferably a solenoid valve and is connected to a controller 78.

The deck 16 is preferably set at angle downwardly from horizontal toward the bowl 18, and the outlet 40 is located on the deck 16. The deck 16 is preferably angled between 30 degrees and 60 degrees from horizontal.

Referring again to FIGS. 5 and 6, an ozone generator 72 is located in the chamber 32, preferably in the first chamber portion 44. In a preferred embodiment, a threaded opening 74 is provided in the bottom 52 in which the ozone generator 72 can be attached in a sealed manner. The ozone generator is of the known type such as an electrolytic cell which generates ozone in the water through electrolysis, i.e. a current is applied between two electrodes, which dissociates water into oxygen and hydrogen. Oxygen can recombine to certain extent to form ozone. The electrolytic cell (also termed electrochemical cell) generally includes two electrodes, one of which is configured as an anode and the other is configured as a cathode and a polymer electrolyte membrane (proton exchange membrane, ion exchange membrane) disposed between the two. The electrodes (the anode at least) are formed from an electrically conductive carrier, which is coated with a synthetic diamond material. The diamond material, which is electrically isolating as such, is doped with boron thus turning the diamond into a semiconductor, i.e. boron doped diamond (BDD). The carrier can either be a metal carrier such as a mesh made of niobium or titanium, or can be made of silicon, such as a molded silicon wafer. One preferred ozone generator is available from Ozomax Inc. under the trade name "Ozo-Pen". As shown in FIG. 8, it can include the ozone pen (indicated at 72 in FIG. 8), as well as an outer cover 73.

Preferably, a sensor 76 is located in or on the sink bowl 18. This sensor 76 detects a user's presence, preferably by detecting the user's hands in the sink bowl 18. A preferred sensor is an IR sensor that is mounted to the back side of the bowl 18. The IR sensor 76 is preferably located in a wall of the bowl below the faucet 30, requiring a user to place their hands down within the bowl 18 to activate the water flow which reduces splashing. The sensor 76 is connected to the controller 78 which is configured to activate the ozone generator 72 for a predetermined time period upon receiving a signal from the sensor 76 of the user's presence, preferably by the sensor 76 detecting the user's hands being extended into the sink bowl, and is also configured to open the flow control valve 70.

In one embodiment, the predetermined time period is at least 20 seconds in which the ozone generator 72 is run, which is independent of the flow control valve 70 being opened or closed. Preferably, the controller 78 is configured to run the ozone generator 72 for at least 30 seconds after the flow control valve 70 is turned off in order to build up the ozone concentration in the water located in the chamber 32 such that after a user wets their hands and applies soap and lathers up for the WHO recommended lathering period of at least 20 seconds, the ozone concentration builds up prior to the user reinserting their hands into the bowl to be detected by the sensor 76 and reinitiating a flow of water from the outlet 40 via the controller 78 opening the flow control valve 70. Alternatively, it is also possible and covered by the subject invention that the ozone generator is only run when the water is actuated so as to reduce maintenance costs.

In a further preferred embodiment, the controller 78 is configured to run an automatic cycle on a periodic basis in which the ozone generator 72 is activated in the chamber 32 that is filled with water, and after a predetermined time period, such as 30 seconds, the controller 78 opens the flow control valve 70 to flush the sink with water including the concentrated ozone. The controller 78 is preferably a pic or other microprocessor based controller that is programmable in order to carry out the described functions.

Referring to FIG. 7, the outlet 40 is preferably a laminar flow outlet having an axis 80 extending perpendicular to the deck 16. A water illumination LED is mounted to the chamber 32 in a position aligned with the water outlet axis 80. The controller 78 is configured to activate the LED 82 upon opening the flow control valve 70. The LED 82 directs a beam of light along water outlet axis 80 illuminating the laminar flow water stream 20 exiting the water outlet 40.

Referring now to FIGS. 7 and 8, an overflow port 84 is preferably located between the top 34 of the chamber 32 and the outlet 40. The overflow port 84 includes a connector 86 that leads to the drain line hidden behind the sink 12 in order to allow an increased volume of water in the chamber 32 due to ozone generation to flow into the drain line without dripping into the sink 12 during ozone generation.

Figure 9:
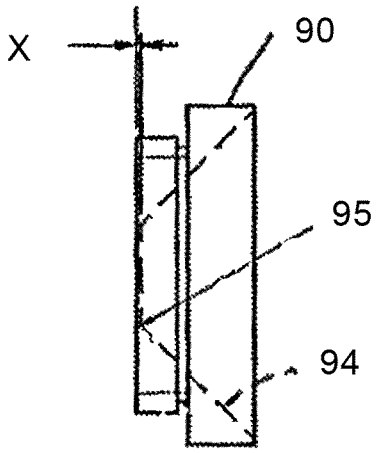
FIG. 9 is an enlarged detailed view of the outlet nozzle.

Referring to FIGS. 7-9, a laminar flow nozzle 90 is preferably located in the outlet 40. The laminar flow nozzle 90 can be formed as an integral part of the cap 62, as shown in FIG. 8, or can be implemented as a separate part shown in FIG. 9. Nozzle 90 includes a sharp edge 92, shown in detail in FIG. 9, having a dimension X of approximately 0.01-0.02 inches. This sharp edge 92 transitions into a conical discharge surface 94 in order to provide a laminar flow stream 20 from the faucet 30. The nozzle 90 preferably opens into a tubular path of a cover piece or bezel 41 in which the outlet 40 is formed. The faucet 30 is preferably clamped to the deck 16 as shown in FIG. 7 with only the cover piece or bezel 41 being exposed on the angled deck 16. As shown in FIG. 8, gaskets or seals 98 may be provided between the top of the cap 62, the deck 16 and the bezel 41.

Referring again to FIG. 1, a method of using a sink 12 and touchless faucet assembly 30 will be described. The method includes providing a sink 12 as described above including the sensor 76 that detects a user's presence, preferably by the user's hands being placed in the sink bowl 18. Here, the controller 78 is configured to activate the ozone generator 72 for a predetermined time period upon receiving a signal from the sensor of the user's presence and is also configured to open the flow control valve 70. The user places their hands in the bowl 18, and the sensor 76 detects the user's hands and signals the controller 78. The controller 78 then activates the ozone generator 72 and opens the inlet valve 70. Water enters the chamber 32 from the flow control valve 30 and rises through the chamber 32 and is converted into a laminar flow as it passes through the first and second meshes 42, 46 prior to being discharged as a laminar water stream, preferably via the nozzle 90, from the outlet 40 into the bowl 18. The user then withdrawals the user's hands from a range of the sensor 76, preferably in order to lather for at least 20 seconds in accordance with the WHO recommendations for sanitary hand cleaning. At this point, the sensor 76 signals the controller 78 and the controller 78 closes the flow control valve 70 and continues to operate the ozone generator 72 to increase a concentration of ozone in the water in the chamber 32. The user then reinserts the user's hands within a range of the sensor 76, and the sensor 76 signals the controller 78 to open the flow control valve 70. The controller 78 then opens the flow control valve 70 and continues to operate the ozone generator 72 so that a laminar water stream 20 with increased ozone concentration is discharged through the outlet 40.

In accordance with a further aspect of the method, the controller 78 is also configured to carry out a periodic automatic cycle for sanitizing the sink 12, which includes running the ozone generator 78 for a predetermined time period in the water filled chamber 32, preferably for 30 seconds or more, and then the controller 78 opens the flow control valve 70 to discharge water from within the chamber 32 into the bowl 18 to flush the sink 12 with ozone rich water in order to remove bacteria.

Preferably during use, the controller 78 provides power to the LED 82 during the time period that the ozone generator 78 is active, providing illumination to the laminar water flow stream emanating from the outlet 40 into the bowl 18 so that there is a visual identification that the ozone generator is on. When a user's hands are not in the laminar water flow stream 20, the laminar water flow stream is directed at the water diversion rib 22 in order to reduce splashing.

While the preferred embodiment of the invention has been described in detail, those skilled in the art will recognize that other changes could be made to the sink and faucet arrangement without departing from the scope of the present invention. Other arrangements could be provided and the specific configuration could be varied without departing from the scope of the present invention. Accordingly, the scope of the invention should not be limited by the preferred embodiments discussed above and instead should be defined by the claims as noted below.

The invention claimed is:

1. A hospital sink and faucet assembly, comprising: a sink (12) with a sink body having an angled faucet deck (16), a bowl (18) adapted to receive water, and a rim (21); a laminar flow faucet (30) connected to the faucet deck (16) having an outlet (40) adapted to direct a laminar flow water stream (20) into the bowl (18), the laminar flow faucet (30) comprising: an elongate chamber (32) having a top (34) and a bottom (36), a water inlet (38) located at the bottom (36) and the outlet (40) being located at the top (34), a first mesh (42) extending across a transverse cross-section of the chamber (32) at a medial position between the top (34) and the bottom (36) to define a first chamber portion (44) between the bottom (36) and the first mesh (42), the first mesh (42) having a first open area, wherein the first mesh (42) creates a laminar velocity profile for the water flow across the transverse cross-section of the chamber (30); a flow control valve (70) connected to the water inlet (38); wherein the deck (16) is set at an angle downwardly from horizontal toward the bowl (18), and the outlet (40) is located on the deck (16); an ozone generator (72) located in the chamber (32); a sensor (76) that detects a user's presence, and a controller (78) configured to open the flow control valve (70) upon receiving a signal from the sensor (76) of the user's presence and configured to also activate the ozone generator for a predetermined time period upon receiving a signal from the sensor of the user's presence.

2. The hospital sink and faucet assembly of claim 1, wherein the predetermined time period is at least 20 seconds and is independent of the flow control valve being open or closed.

3. The hospital sink and faucet assembly of claim 1, wherein the sensor (76) is an IR sensor and is located in a wall of the bowl below the faucet.

4. The hospital sink and faucet assembly according to claim 1, wherein the controller (78) is configured to run an automatic cycle on a periodic basis in which the ozone generator (72) is activated, and after a second predetermined time period, the controller (78) opens the flow control valve (70) to flush the sink (12) with water.

5. The hospital sink and faucet assembly according to claim 1, wherein the outlet (40) is a laminar flow outlet having an axis extending perpendicular to the deck (16), and a water illumination LED (82) is mounted to the chamber (32) in a position aligned with the water outlet axis, and the controller (78) being configured to activate the LED (82) upon opening the flow control valve (70), the LED (82) directing a beam of light (80) along the water outlet axis illuminating the laminar flow water stream (20) exiting the outlet (40).

6. The hospital sink and faucet assembly according to claim 1, wherein a portion of the laminar flow faucet (30) is located below the deck (16) and behind the bowl (18).

7. The hospital sink and faucet assembly according to claim 1, further comprising an overflow port (84) located between the chamber (32) and the outlet (40).

8. The hospital sink and faucet assembly according to claim 1, further comprising a water diversion rib (22) extending up from a bottom (24) of the bowl (18) and aligned with a direction of the outlet (40) such that the laminar flow water stream (20) discharged from the outlet (40) is adapted to strike the water diversion rib (22).

9. The hospital sink and faucet assembly according to claim 1, wherein the outlet (40) includes a laminar flow nozzle (90).

10. The hospital sink and faucet assembly according to claim 1, wherein the water inlet (38) is arranged tangentially at the bottom (36) of the chamber (32) to impart a swirling motion to water entering the chamber (32).

11. The hospital sink and faucet assembly of claim 1, wherein the first mesh is formed of PTFE and has an open area of 55%-85%.

12. The hospital sink and faucet assembly of claim 1, wherein the ozone generator (72) is located in the first chamber portion (44).

13. A hospital sink and faucet assembly, comprising: a sink (12) with a sink body having an angled faucet deck (16), a bowl (18) adapted to receive water, and a rim (21); a laminar flow faucet (30) connected to the faucet deck (16) having an outlet (40) adapted to direct a laminar flow water stream (20) into the bowl (18), the laminar flow faucet (30) comprising: an elongate chamber (32) having a top (34) and a bottom (36), a water inlet (38) located at the bottom (36) and the outlet (40) being located at the top (34), a first mesh (42) extending across a transverse cross-section of the chamber (32) at a medial position between the top (34) and the bottom (36) to define a first chamber portion (44) between the bottom (36) and the first mesh (42), the first mesh (42) having a first open area, wherein the first mesh (42) creates a laminar velocity profile for the water flow across the transverse cross-section of the chamber (30); a flow control valve (70) connected to the water inlet (38); wherein the deck (16) is set at an angle downwardly from horizontal toward the bowl (18), and the outlet (40) is located on the deck (16); a second mesh (46) extending across the cross-section of the chamber (32) at a location between the first mesh (42) and the top (34), defining a second chamber portion (48) between the first and second meshes (42, 46) and a third chamber portion (50) between the second mesh (46) and the top (34), and the second mesh (46) has a second open area that is equal or less than the first open area.

14. The hospital sink and faucet assembly of claim 13, wherein the second mesh is formed of PTFE and has an open area of 30%-65%.

15. The hospital sink and faucet assembly of claim 13, further comprising an ozone generator (72) located in the chamber (32).

16. A method of using a sink (12) and touchless faucet assembly (30), comprising:

providing sink (12) having:

a sink body with an angled faucet deck (16), a bowl (18) adapted to receive water, and a rim (21), and a laminar flow faucet (30) connected to the faucet deck (16) having an outlet (40) adapted to direct a laminar flow water stream (20) into the bowl (18), the laminar flow faucet (30) including:

a chamber (32) having a top (34) and a bottom (36), a tangentially arranged water (38) inlet located at the bottom (36) and the outlet (40) being located at the top (34), a first mesh (42) extending across a transverse cross-section of the chamber (32) at a medial position between the top (34) and the bottom (36) to define a first chamber portion (44) between the bottom (36) and the first mesh (42), the first mesh (42) having a first open area, a second mesh (46) extending across the transverse cross-section of the chamber (32) at a location between the first mesh (42) and the top (34), defining a medial chamber (48) portion between the first and second meshes (42, 46) and an upper chamber portion (50) between the second mesh (46) and the top (34), the second mesh (46) having a second open area that is equal or less than the first open area, the first and second meshes (42, 46) creating a laminar water flow to the outlet (40), and a flow control valve (70) connected to the water inlet (38), the deck (16) is set at an angle downwardly from horizontal toward the bowl (18), and the outlet (40) is located on the deck (18), an ozone generator (72) located in the chamber (32), a sensor (76) that detects a user's presence, and a controller (78) configured to activate the ozone generator (72) for a predetermined time period upon receiving a signal from the sensor (76) of the user's presence, and configured to open the flow control valve (70);

a user placing their hands in the bowl (18);

the sensor (76) detecting the user's hands and signaling the controller (78), and the controller (78) activating the ozone generator (72) and opening the flow control valve (70);

water entering the chamber (32) from the flow control valve (70), rising through the chamber (32), and converting into a laminar flow as it passes through the first and second meshes (42, 46), and discharging the laminar water stream (20) from the outlet (40) into the bowl (18);

the user withdrawing the user's hands from a range of the sensor (76);

the sensor (76) signaling the controller (78), and the controller (78) closing the flow control valve (70) and continuing to operate the ozone generator (72) to increase a concentration of ozone in the water in the chamber (32);

the user reinserting the user's hands within a range of the sensor (76); and the sensor (76) signaling the controller (78) to open the flow control valve (70) and continuing to operate the ozone generator (72) so that a laminar water stream (20) with the increased ozone concentration is discharged through the outlet (40).

17. The method of claim 16, further comprising the controller (78) carrying out a periodic automatic cycle, including running the ozone generator (72) for a second predetermined time period, and then opening the flow control valve (70) to discharge water from within the chamber (32) into the bowl (18) to flush the sink (12) with water to remove bacteria.

* * * * *